United States Patent [19]

O'Neill

[11] Patent Number: 4,984,920

[45] Date of Patent: Jan. 15, 1991

[54] CLOSURE ASSEMBLY HAVING AN AXIALLY MOVABLE LIQUID DISPENSER

[75] Inventor: R. Kevin O'Neill, Wrightwood, Calif.

[73] Assignee: Calmar, Inc., Watchung, N.J.

[21] Appl. No.: 381,977

[22] Filed: Jul. 19, 1989

[51] Int. Cl.[5] ..... A46B 11/00

[52] U.S. Cl. ..... 401/127; 401/129; 401/116

[58] Field of Search ..... 401/127, 129, 126, 112, 401/102, 103, 116, 130, 262, 1

[56] References Cited

U.S. PATENT DOCUMENTS

| | | | |
|---|---|---|---|
| 571,367 | 11/1896 | Higgins | 401/129 |
| 1,365,103 | 1/1921 | Hoffmann | 401/127 |
| 1,626,992 | 5/1927 | Willk | 401/116 |
| 2,517,663 | 8/1950 | Hendry et al. | 401/127 |
| 3,157,905 | 11/1964 | Levy | 401/127 |
| 4,219,283 | 9/1980 | Buckley et al. | 402/129 |
| 4,313,686 | 2/1982 | Proffer | 401/127 |

FOREIGN PATENT DOCUMENTS

| | | | |
|---|---|---|---|
| 334391 | 3/1921 | Fed. Rep. of Germany | 401/116 |
| 3605857 | 8/1987 | Fed. Rep. of Germany | 401/129 |
| 17869 | 6/1913 | France | 401/116 |
| 536184 | 4/1922 | France | 401/116 |
| 154556 | 9/1921 | United Kingdom | 401/116 |

*Primary Examiner*—Danton D. DeMille

*Attorney, Agent, or Firm*—Watson, Cole, Grindle & Watson

[57] ABSTRACT

A closure assembly having an axially movable liquid dispenser comprises a hollow sleeve open at one end and mounted at its other end to a container of liquid to be dispensed, a liquid dispenser adjuster cap mounted without axial movement on such one end for rotation about a central axis of the sleeve, the dispenser comprising a stem mounted for axial movement inwardly and outwardly of the sleeve, a container seal mounted on the sleeve in engagement with the stem to prevent stem rotation upon axial movement, and the stem threadedly engaging an internally threaded tube fixedly mounted on the cap to effect axial movement upon cap rotation.

6 Claims, 1 Drawing Sheet

CLOSURE ASSEMBLY HAVING AN AXIALLY MOVABLE LIQUID DISPENSER

BACKGROUND OF THE INVENTION

This invention relates generally to a closure assembly for a liquid container, the assembly including a liquid dispenser such as a brush applicator. More particularly, the liquid dispenser is axially movable for extending substantially completely to the bottom of the container for reaching into the liquid regardless of the level of liquid in the container.

Liquid container closures having a liquid applicator or other type liquid dispenser of a fixed length present several problems in use. For example, the shank on which the dispenser is mounted becomes wetted with liquid when extending into a full or nearly full liquid container, thus presenting a messy condition requiring the shank to be wiped off after the cap is removed from the bottle. Moreover, when the level of liquid in the container is low, the closure must be either threaded down onto the container to assure that the dispenser reaches the liquid, or the closure is unthreaded from the container and the dispenser shank is tilted into a corner of the container to reach the liquid. In either case, the operation is cumbersome without any assurance of the applicator or dispenser reaching the liquid.

Closure assemblies having extendable liquid applicators have been devised, such as that disclosed in U.S. Pat. Nos. 4,313,686 (Proffer), 3,157,905 (Levy) and 4,219,283 (Buckley). In Proffer, the applicator shank is spring biased to a position of maximum expansion relative to the open end of the cap and is equipped with an abutment disc for abutting the outer end of the associated container threaded neck for partially retracting the shank in response to threaded engagement of the cap with the container neck. The shank on the Buckley cap is telescoped requiring extension upon application of a manual downward force on a peg located on a telescoping part of the shank. And, Levy provides for axial shifting of a handle supporting the applicator shank upon threading and unthreading relative to the closure cap.

Each of these attempts made at extending the applicator shank into the liquid container suffers from one or more disadvantages. For example, the Proffer assembly is cumbersome and costly because of the many parts required. In the Buckley assembly, the user's fingers are wetted each time the telescoping shank is manually extended, and the threaded shank of Levy interferes with the threaded engagement between the cap and the bottle when operated.

SUMMARY OF THE INVENTION

It is therefore an object of the present invention to avoid the difficulties encountered with prior art extendable liquid applicators on closure assemblies for liquid containers, by the provision of a closure assembly including an axially movable liquid dispenser of simple and economical construction having few moving parts rendering it easy to use and highly effective in gaining access to the liquid in the container regardless of its level.

In accordance with the invention, the closure assembly has a hollow sleeve open at one end with a container mounting means such as internal threading at its opposite end. A liquid dispenser adjuster cap is mounted without axial movement on such one end for rotation about the central axis in the sleeve. The dispenser comprises a stem mounted for axial movement inwardly and outwardly of the sleeve, and means on the sleeve engages the stem to prevent stem rotation upon axial movement. Cooperating means on the cap and on the stem effect axial stem movement upon rotation of the cap about the central axis of the sleeve.

Such cooperating means may comprise an internally threaded tube mounted on the cap for rotation together therewith and extending into the sleeve, and thread means on an inner end of the stem engaging with the internally threaded tube for effecting axial movement of the stem upon rotation of the cap.

The means on the sleeve which engages the stem to prevent stem rotation upon such axial movements is in the form of a container seal ring in liquid-tight engagement with the stem.

Other objects, advantages and novel features of the invention will become more apparent from the following detailed description of the invention when taken in conjunction with the accompanying drawings.

DETAILED DESCRIPTION OF THE INVENTION

Figure 2:
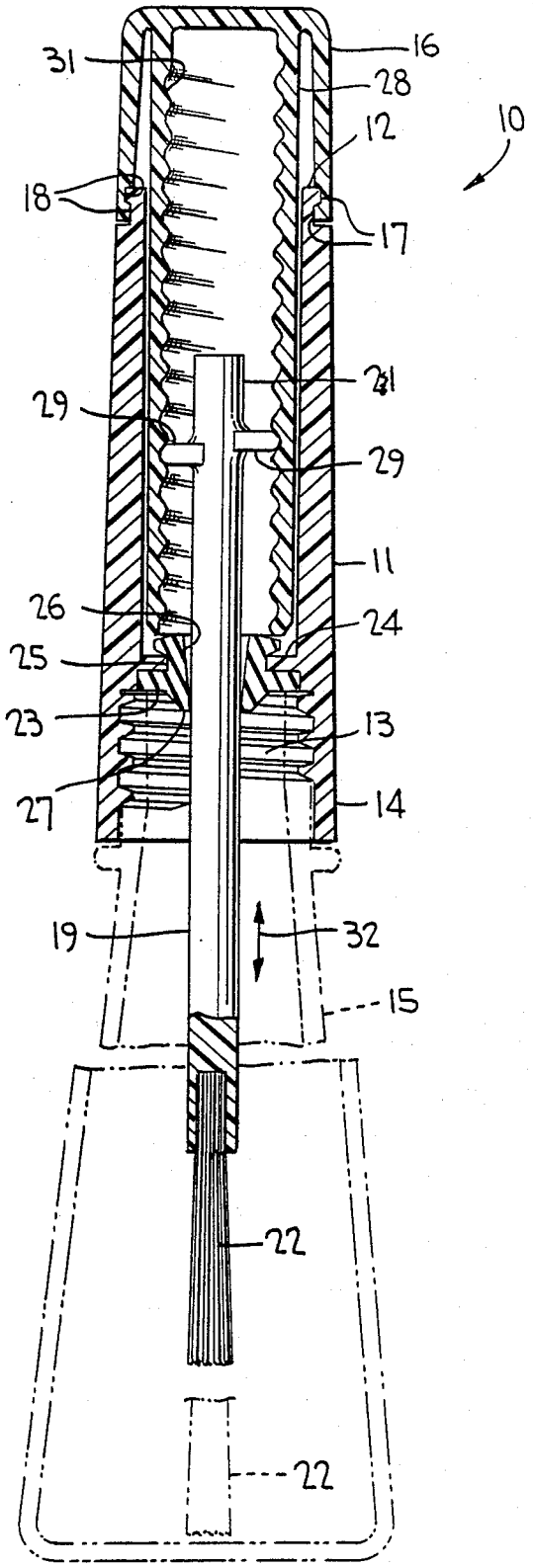
FIG. 2 is a vertical sectional view of the FIG. 1 assembly as mounted on a container shown in phantom outline.
Figure 1:
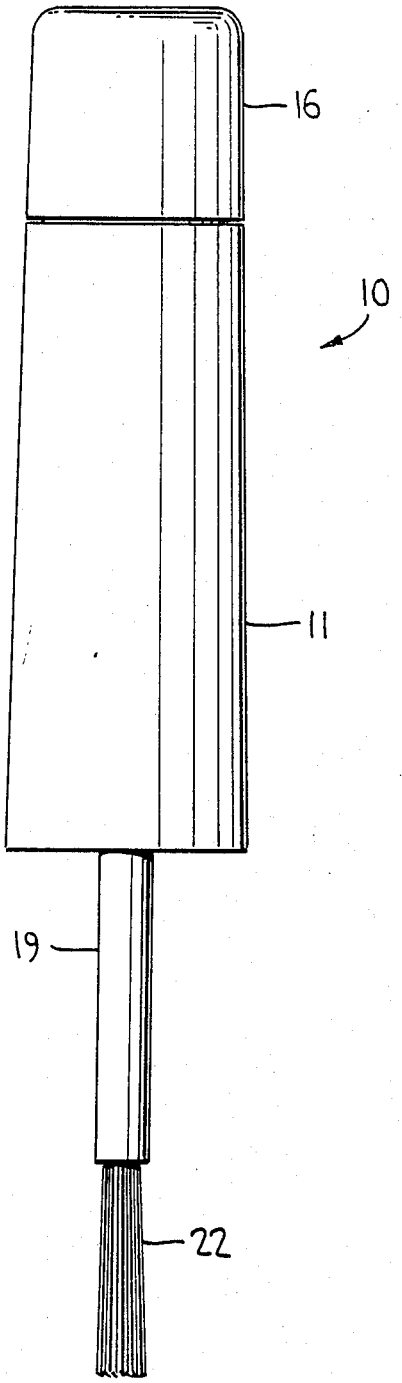
FIG. 1 is a typical side elevational view of the closure assembly according to the invention.

Turning now to the drawings wherein like reference characters refer to like and corresponding parts throughout the several views, the closure assembly, generally designated 10, comprises a hollow elongated sleeve 11 open at one end 12 and being internally threaded as at 13 at its opposite end 14. Threads 13 engage with corresponding external threads provided on the neck of a container 15 of liquid to be dispensed. Of course, the engaging threads on the sleeve and container neck may be substituted by a snap fit or the like engagement for mounting the assembly on the container.

A liquid dispenser adjuster cap 16 is mounted over open end 12 of the sleeve such as by interengaging annular tongues 17 and annular grooves 18 interengaging between the cap and the sleeve to facilitate manual rotation of the cap relative to the sleeve about the central axis of the sleeve without axial movement of the cap. Of course, the cap may be otherwise engaged with the sleeve to facilitate manual cap rotation without axial movement, without departing from the invention.

A liquid dispenser, shown as a liquid applicator, comprises an elongated stem 19 mounted for inward and outward axial movement relative to the sleeve. One end 21 of the stem extends into the interior of the sleeve, and a brush applicator 22 is mounted on its opposite end in some suitable manner. Of course, other types of liquid dispensers may be otherwise mounted on the stem in lieu of the brush applicator, such as a medicine spoon, a dauber pad, etc., without departing from the invention.

An annular seal 25 of elastomeric material such as plastic or rubber is mounted within the sleeve such as by a snap fit between an internal flange 24 on the sleeve and an external groove on the seal. Central opening 26 of the seal is downwardly conically shaped so that its feathered lower end 27 liquid tightly engages stem 19 to seal against any leakage of liquid outwardly of the seal should the container be inverted or tipped. Moreover, the seal has a laterally extending flange 23 which overlies the container neck and bears tightly thereagainst as sleeve 11 is threaded down onto the container neck. The seal moreover frictionally engages stem 19 to prevent any tendency of the stem to rotate during its axial movement relative to the seal.

Such axial movement is effected by the provision of an internally threaded tube 28 formed integrally with cap 16 or otherwise connected thereto for rotation together with the cap about the longitudinal axis of the sleeve. The tube axis is coincident with the sleeve axis and terminates at its inner end adjacent seal 25. The stem is provided at its inner end 21 with a pair or transversely extending nibs 29 which are relatively staggered in an axial direction and which engage the internal thread 31 of tube 28. The outer ends of the nibs are suitably rounded to smoothly engage the turns of thread 31 in a substantially friction-reduced manner.

In operation, with the sleeve threaded down on the container neck, manual rotation of cap 16 about its central axis correspondingly rotates the internally threaded tube causing the stem to shift axially in either direction of double arrow 13 depending on the direction of rotation of the cap. Thread nibs 29 facilitate axial stem movement as the frictional engagement between seal 23 and the stem prevents stem rotation and converts it to axis movement.

Thus, when shifted outwardly of the closure assembly further into the container, brush applicator is axially moved from its solid outline position of FIG. 2 to its phantom outline position substantially completely to the bottom of the container as necessary depending on the level of the liquid in the container.

When the container is full or nearly full of liquid such as nail polish, paint, lacquer, or medicine if a spoon dispenser is used, the stem is retracted upon cap rotation before mounting the assembly on the bottle to avoid excessive wetting of the stem. The liquid is dispensed in the normal manner each time the sleeve is unthreaded from the bottle. Thereafter, the stem may be simply extended until the attached dispenser is immersed into the liquid as seen through the bottle which may be made clear for this purpose. Substantially all the liquid in the container is capable of being reached by applicator 22 as the stem is appropriately extended upon cap rotation.

Obviously, many other modifications and the variations of the present invention are made possible in the light of the above teachings. It is therefore to be understood that within the scope of the appended claims the invention may be practiced otherwise than as specifically described.

What is claimed is:

1. A closure assembly having an axially movable liquid dispenser, comprising a hollow sleeve open at one end and having container mounting means at an opposite end, a liquid dispenser adjuster cap mounted without axial movement on said one end for rotation about a central axis of said sleeve, said liquid dispenser comprising a stem mounted for axial movement inwardly and outwardly of said sleeve, means on said sleeve in engagement with said stem to prevent stem rotation upon said axial movement, cooperating means on said cap and on said stem for effecting said axial movement upon rotation of said cap about said central axis, said means on said sleeve comprising a separate seal ring of elastomeric material in liquid tight engagement with the outer surface of said stem, and said seal ring comprising a container seal having a laterally extending flange for overlying an edge of a container to which said sleeve is to be mounted for providing a seal between said sleeve and the container.

2. The assembly according to claim 1, wherein said cooperating means comprise an internally threaded tube mounted on said cap for rotation therewith and extending into said sleeve, and thread means on an inner end of said stem in engagement with said internally threaded tube.

3. A closure assembly for a liquid container, the assembly including an axially movable liquid dispenser comprising, a hollow sleeve open at one end and having container mounting means at an opposite end, a liquid dispenser adjuster cap mounted on said one end for rotation about a central axis of said sleeve, said cap having an internally threaded tube extending into said sleeve for rotation together with said cap, said liquid dispenser comprising a stem having one end located within said tube and an opposite end extending outwardly of said container mounting means, liquid dispenser means on said opposite end of said stem, thread means on said one end of said stem in engagement with said internally threaded tube, and means on said sleeve engaging said stem top prevent rotation of said stem about said axis upon rotation of said cap causing axial shifting movement of said stem, said engaging means comprising a separate seal ring of elastomeric material in liquid tight engagement with the outer surface of said stem, and said seal ring comprising a container seal having a laterally extending flange for overlying an edge of a container to which said sleeve is to be mounted for providing a seal between said sleeve and the container.

4. The assembly according to claim 3, wherein said sleeve and said cap having interengaging annular tongues and grooves to effect cap rotation about said central axis.

5. The assembly according to claim 3, wherein said thread means on said opposite end of said stem comprises an oppositely extending pair of studs relatively staggered along said axis.

6. The assembly according to claim 3, wherein said liquid dispenser means comprises a brush applicator.

* * * * *